United States Patent [19]

Curti

[11] Patent Number: 4,472,893

[45] Date of Patent: Sep. 25, 1984

[54] CALENDAR AGENDA

[76] Inventor: Sandro Curti, S. Croce 515, Venice, Italy

[21] Appl. No.: 450,067

[22] Filed: Dec. 15, 1982

[30] Foreign Application Priority Data

Dec. 15, 1981 [IT] Italy ..... 84149 A/81

[51] Int. Cl.[3] ..... G09D 3/00

[52] U.S. Cl. ..... 40/107; 283/2

[58] Field of Search ..... 40/107, 109; 283/2, 283/3, 4

[56] References Cited

U.S. PATENT DOCUMENTS

| | | | |
|---|---|---|---|
| 773,669 | 11/1904 | O'Shaughnessy | 283/2 |
| 1,415,883 | 5/1922 | Lewis | 283/2 |
| 1,608,411 | 11/1926 | Mateju | 283/2 |
| 2,768,459 | 10/1956 | Corbett | 283/2 |

FOREIGN PATENT DOCUMENTS

| | | | |
|---|---|---|---|
| 2038042 | 7/1980 | United Kingdom | 283/2 |

OTHER PUBLICATIONS

"Ready Reference Calendar", p. 36 of the 1920 World Almanac, (Figures the Day of the Week).

"Perpetual Calendar", p. 324 of the New Intl. Encyclopedia, Edition of 1914.

*Primary Examiner*—John J. Wilson

*Attorney, Agent, or Firm*—D. Paul Weaver

[57] ABSTRACT

A calendar device includes first and second distinct cooperative sections. In the first section, calendar years are arranged in several groups and each group of years is designated by a character or marking to distinguish it from the other groups. In the second calendar section, an indicator for each day of each month is accompanied by indications of the names of the seven weekdays, and adjacent to the weekday indications are the characters or markings which identify years in the several groups of the first calendar section.

3 Claims, 5 Drawing Figures

CALENDAR AGENDA

BACKGROUND OF THE INVENTION

This invention relates to a calendar arrangement or device.

The objective of the invention is to provide a calendar arrangement which can be printed on a one-time basis and can be used on a continuing basis substantially without limit as a perpetual calendar. At present, calendars in many forms are provided for a particular designated year, and such calendars contain all necessary information for the number of the days of the month and their order, and also for the names of the days of the week. However, the utility of conventional calendars is limited to one particular year and their informational content cannot be coupled with that of the ensuing years. This limitation results in considerable waste and high cost, as the calendar for each year must be discarded after December and must be replaced by a new calendar.

These drawbacks are entirely eliminated by the present invention by the provision of a calendar whose utility is not limited to any one year, but indeed, may be used substantially as a perpetual calendar requiring only a one-time printing or manufacturing. The calendar arrangement according to this invention comprises first and second distinct cooperative sections. In the first section, calendar years beginning with any chosen year are arranged in plural groups and each group is identified by a character, symbol or marking, such as a distinctive color, to differentiate it from every other group in the first calendar section. In the second calendar section, an indicator for each day of each month is accompanied by designations of the seven weekdays, and adjacent to the weekday designations are the characters, symbols or markings which designate the groups of years in the first calendar section so that a particular year in any such group can be linked with a month date and weekday indication of the second calendar section. A separate embodiment taking into account leap years is included.

DETAILED DESCRIPTION

Figure 1:
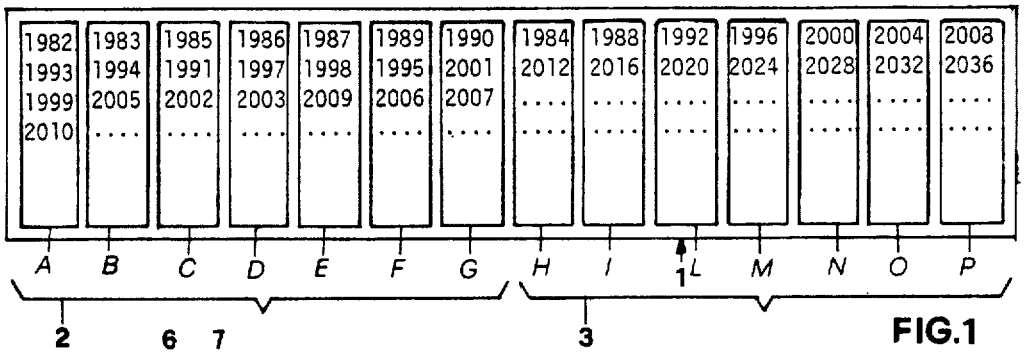
FIG. 1 is a schematic view of a first calendar section according to one embodiment of the invention.
Figure 2:
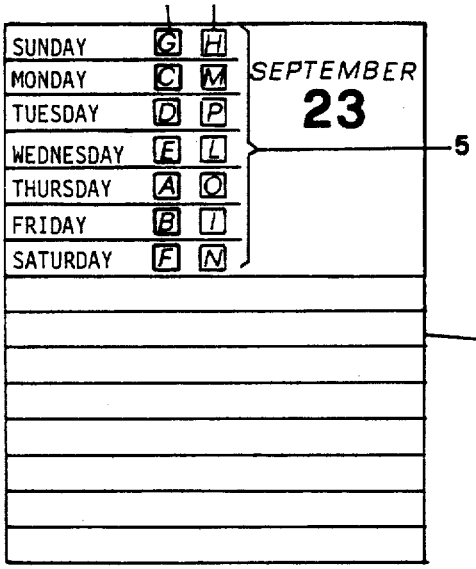
FIG. 2 designates a page or other indicator of a month date and weekday designations forming a part of the second calendar section in the first embodiment.

Referring to the drawings in detail, and referring first to FIGS. 1 and 2, a calendar arrangement or device according to a first embodiment of the invention comprises a first calendar section 1 comprising two zones 2 and 3. Each zone 2 and 3 consists of seven distinct groups or calendar years, the groups of years in zone 2 being designated A, B, C, D, E, F and G, and the seven groups of years in zone 3 being designated H, I, L, M, N, O and P. Other forms of markings or symbols can be used to identify the fourteen year groups of calendar section 1. The year groups could also be identified by distinct colorings.

The two zones 2 and 3 of year groups are derived from the fact that all years, past and future, can be divided into fourteen groups each having a different configuration, with the years in any group adapted to be coupled with month dates and days of the week for that particular date. Seven of the fourteen year groups are based on the fact that Jan. 1st or any date can fall on any day of the week and the seven year groups double to fourteen if one keeps in mind the normal years (365 day) and the leap years (366 days).

Calendar section 1 can begin with any year and can extend into future years without limit. The year 1982, in the first group A, FIG. 1, is chosen arbitrarily and the invention is not limited to the particular years shown in FIG. 1. The desired number of years, past or future, are grouped according to their chronology in zone 2, groups A . . . G, while the leap years in the same span of time are grouped H . . . P in zone 3 of calendar section 1. Each group has the years therein compiled initially from a study or analysis of the Gregorian calendar in the past and future.

The calendar arrangement also comprises a second cooperative calendar section made up from a plurality of sheets 4 or other indicators on which the consecutive dates of the year are displayed (September 23) shown in FIG. 2 being merely a single date in one month of the year, it being understood that a complete calendar device according to the invention will include a sheet 4 for each day of each month of the year.

Adjacent to the month date of each sheet or indicator 4 within a zone 5 of the same is provided a further designation of the seven weekdays in order beginning with Sunday and ending with Saturday. Adjacent to the weekday designations in individual boxes 6 and 7 arranged in columns are the characters A . . . P designating the groups of years in zones 2 and 3 in calendar section 1 which are capable of being coupled with a particular month date and weekday for any given year, past or future. More particularly, the characters in boxes 6 correspond to year groups A . . . G in zone 2 (regular years) while the characters in boxes 7 correspond to groups H . . . P in zone 3 (leap years).

In using the calendar device according to the embodiment in FIGS. 1 and 2, once the year under consideration is chosen, the examination of calendar section 1 allows immediate determination of the character A, B, C, etc. associated with it. Then, in the second calendar section 4, the user can apply to any date of the year the correct weekday name by checking the character adjacent to it matching the character of one of the year groups in the first calendar section. For the remainder of the particular year, the determination of the proper weekday name for any date can be quickly determined in the second calendar section.

Figure 3:
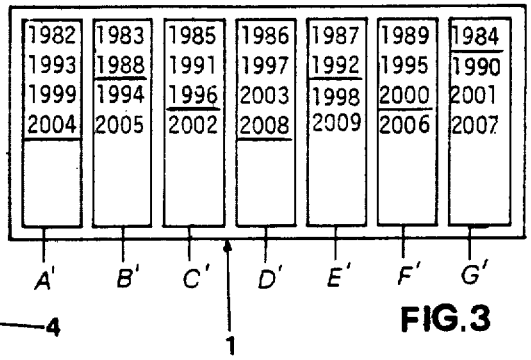
FIG. 3 is a schematic view of a first section of a calendar device according to a second embodiment.
Figure 4:
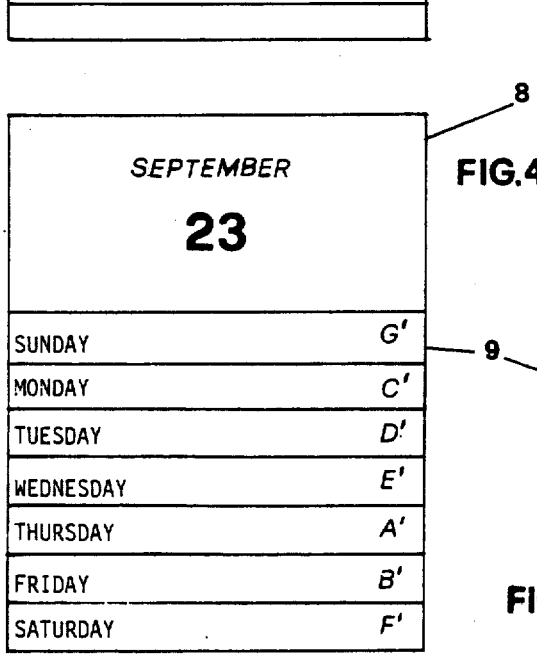
FIG. 4 designates a page or other indication of a month date and weekdays forming a part of the second section of the calendar device according to the second embodiment.
Figure 5:
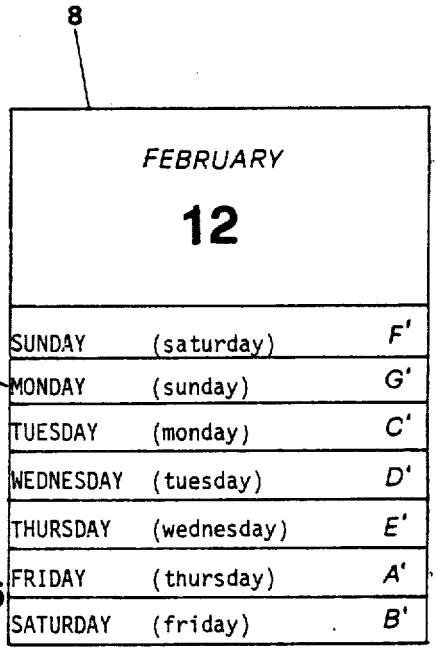
FIG. 5 is a similar view of a page or other indicator in the second section of the calendar according to the second embodiment.

In a second embodiment of the invention shown in FIGS. 3, 4 and 5, a first calendar section 1' has years in a chosen period of time, including regular years and leap years, arranged in seven distinct groups A', B', C', D', E', F' and G'. The leap years in these groups of years are underlined, as shown, or otherwise visually marked to distinguish them from regular years. The seven groups A'. . . G' correspond to the seven days of the week in number.

A second section of the calendar in the second embodiment consists of a number of sheets 8 or other indicatoı means sufficient to collectively show all of the days of the year, January through December. The sheets 8 bear the names of the seven days of the week, Sunday through Saturday, in a column at the left hand edge of the sheet 8. These weekday names are coupled with the year groupings in the first section of the calendar by the characters A'. . . G' arranged in a column along the right hand edge of the sheet 8. Additionally, the horizontal strips or areas 9 across the sheets 8 in which the weekday names are printed can be colored to further key the first and second sections of the calendar functionally.

In the portion of the year from March 1st to December 31st, the sheet 8 shown in FIG. 4 is valid to indicate the particular day of the week, Sunday through Saturday, which will occur for any calendar date in the period between March 1st and December 31st for any year in the proper cooperative group A' . . . G' in FIG. 3, both regular years and leap years. In the shorter period of the year between January 1st and February 28th, the modified sheets 8 shown in FIG. 5 are identical to the sheets of FIG. 4 and are used in the same manner above described for all regular years in calendar section 1, FIG. 3. However, within the stated period of January 1st to February 28th, in leap years, referring to underlined year dates in FIG. 3, the weekday designations which apply are shown in parentheses, preferably in small case letters on the sheets 8 of FIG. 5, and it may be noted that in the stated period January 1st to February 28th the days in parentheses precede the weekday designations for the period of March 1st to December 31st by one day. This arrangement on the sheet 8 of FIG. 5 can be understood if one considers the fact in leap years, because of the presence of February 29th, the name of the weekday in the period January 1st to February 28th anticipates or precedes by one day the regular order of weekdays in the period of March 1st to December 31st. For example, if in a normal non-leap year. March 1st falls on Thursday and therefore February 28th falls on Wednesday, for a leap year in which March 1st still falls on Thursday, then February 28th will fall on Tuesday.

The use of the calendar device in the second embodiment is essentially as described relative to the first embodiment shown in FIGS. 1 and 2, except for the fact that in the second embodiment the user must bear in mind the above-described distinction between the calendar periods of March 1st to December 31st and January 1st to February 28th. In the former period, the sheet 8 in FIG. 4 or in FIG. 5 can be used cooperatively with calendar section 1', FIG. 3, to determine the weekday name on any calendar date for any year, regular or leap year, in FIG. 3 by matching the characters A' . . . G' in the first and second calendar sections. In the latter calendar period, however, the sheet 8 according to FIG. 5 must be used because, during this calendar period for leap years only, the weekday names shown in parentheses will precede by one day the weekday names in non-leap years.

I claim:

1. A calendar arrangement comprising a first calendar section consisting of a plurality of distinct columns of years including regular years and leap years in the columns, each column of years in the first calendar section having a visual symbol distinct from the symbol of every other column of years at one end of the column, a second physically separate calendar section comprising separate sheets for the calendar days of a complete year, each sheet for each calendar date of the year bearing the name of a month and a numeric date and also bearing the weekday names for a complete week in regular order in a column, each sheet also bearing the visual symbols of the columns of years in the first calendar section and arranged in a column adjacent to the column of weekday names, whereby the visual symbols are readily relatable to years in the columns of years of the first calendar section.

2. A calendar arrangement as defined in claim 1, in which said columns of years in the first calendar section are seven in number and include therein regular years and leap years.

3. A calendar arrangement which enables the ready determination of the weekday name for any calendar date in any year past or future, the arrangement comprising a first calendar section consisting of plural distinct groups of years including regular years and leap years in the groups, said groups of years comprising fourteen distinct groups, seven of which are groups of regular years and seven of which are groups of leap years, each year group in the first calendar section having a visual identifying element distinct from the identifying element of every other group of years in the first calendar section, and a second calendar section physically separated from the first calendar section and consisting of separate sheets for the calendar dates of a complete year, each sheet for each calendar date of the year including weekday names for the complete week in order and each sheet of the second calendar section for each calendar date of the year also including the visual identifying elements of the groups of years of the first calendar section, and said sheets of the second calendar section having said visual identifying elements arranged in two separate columns adjacent to the weekday names, whereby the elements in one column are readily relatable to years in the regular year groups of the first calendar section and said elements in the other column are readily relatable to years in the leap year groups of the first calendar section.

* * * * *